US011506162B2

(12) United States Patent
Brown et al.

(10) Patent No.: US 11,506,162 B2
(45) Date of Patent: Nov. 22, 2022

(54) TRAPPED VOLUME SPLIT CHECK ASSEMBLY IN FUEL INJECTOR

(71) Applicant: Caterpillar Inc., Peoria, IL (US)

(72) Inventors: Cory Andrew Brown, Peoria, IL (US); Sana Mahmood, Albuquerque, NM (US); Dana Ray Coldren, Secor, IL (US); Glenn Brian Cox, Peoria, IL (US); Matthew Robert Vanderveen, Gridley, IL (US)

(73) Assignee: Caterpillar Inc., Peoria, IL (US)

( * ) Notice: Subject to any disclaimer, the term of this patent is extended or adjusted under 35 U.S.C. 154(b) by 73 days.

(21) Appl. No.: 16/950,026

(22) Filed: Nov. 17, 2020

(65) Prior Publication Data

US 2022/0154673 A1 May 19, 2022

(51) Int. Cl.
*F02M 47/02* (2006.01)
*F02M 63/00* (2006.01)

(52) U.S. Cl.
CPC ..... *F02M 47/027* (2013.01); *F02M 63/0054* (2013.01); *F02M 63/0078* (2013.01)

(58) Field of Classification Search
CPC ..... F02M 47/027; F02M 63/0054; F02M 63/0078
USPC ..... 239/89
See application file for complete search history.

(56) References Cited

U.S. PATENT DOCUMENTS 7,278,593 B2 10/2007 Wang et al.
2010/0175665 A1* 7/2010 Burger ..... F02M 61/167 123/456

FOREIGN PATENT DOCUMENTS

| | | | | |
|---|---|---|---|---|
| DE | 102008042789 A1 * | 4/2010 | ..... | F02M 45/02 |
| DE | 102009001704 A1 * | 9/2010 | ..... | F02M 47/027 |
| DE | 102004031308 B4 * | 5/2013 | ..... | F02M 51/0603 |
| DE | 102014225392 A1 * | 6/2016 | | |
| EP | 2108080 A1 | 10/2009 | | |
| WO | WO-2008128884 A1 * | 10/2008 | ..... | F02M 47/027 |
| WO | 2012130452 A1 | 10/2012 | | |

OTHER PUBLICATIONS

WO2008128884 (Eisenmenger et al.) (Oct. 30, 2008) (machine translation) retrieved from EPO website on Mar. 26, 2022. (Year: 2008).*

* cited by examiner

*Primary Examiner* — Mahmoud Gimie
(74) *Attorney, Agent, or Firm* — Brannon Sowers & Cracraft PC

(57) ABSTRACT

A fuel system includes a fuel injector having a split check assembly with a control piece, an outlet piece, and a check sleeve. A trapped volume is formed between the control piece and the outlet piece within the check sleeve, to hydraulically couple the control piece to the outlet piece. A starting rate shape clearance fluidly connects the trapped volume to a fuel cavity and is formed between the check sleeve and one of the control piece or outlet piece received therein, and modulates a starting rate shape of fuel injection from the fuel injector. Related methodology is disclosed.

16 Claims, 5 Drawing Sheets

TRAPPED VOLUME SPLIT CHECK ASSEMBLY IN FUEL INJECTOR

TECHNICAL FIELD

The present disclosure relates generally to a pressurized fuel system, and more particularly to a fuel injector in a pressurized fuel system having a split check assembly with a trapped volume and a starting rate shape clearance for modulating fuel injection rate shape.

BACKGROUND

In recent decades, emissions requirements for internal combustion engines have become increasingly stringent. Engine manufacturers and components suppliers continue to seek strategies for reducing undesired emissions such as particulate matter and oxides of nitrogen or "NOx". Various strategies are known for reducing such emissions in engine exhaust aftertreatment systems, as well as strategies for limiting production of such emissions in the combustion process itself. Most modern internal combustion engine systems employ a combination of strategies for limiting production of emissions as well as trapping or treating emissions that are still invariably produced.

Common targets for promoting a reduction in the production of certain emissions are the process and parameters of fuel delivery into an engine cylinder, notably direct fuel injection in the case of compression-ignition diesel engines. A variety of well-known techniques employ a pressurized reservoir of fuel, conventionally referred to as a common rail, that makes fuel available for injection at a desired injection pressure, and also for actuating various of the moving components within the fuel injectors. Common rail and related strategies have enabled engineers to develop systems that can control fuel injection timing, amount, and rate shape with relatively great precision, but still experience various limitations. It has been observed that optimal operation and performance can be at least theoretically achieved where relatively small quantities of fuel can be precisely injected. Fuel injection systems are often designed for robust performance at a rated load but can suffer from certain limitations when operated at lower loads. In other words, while much of the time an engine and fuel system can be operated as desired, instances remain where inherent hardware limitations of known systems do not practicably provide or support optimal performance. One known common rail fuel injection system is known from U.S. Pat. No. 7,278,593 to Wang et al.

SUMMARY OF THE INVENTION

In one aspect, a fuel injector includes an injector housing defining a longitudinal axis, and having formed therein a high pressure inlet, a fuel cavity fluidly connected to the high pressure inlet, a low pressure drain, and a check control chamber. The injector housing further includes a nozzle having formed therein a plurality of spray orifices. The fuel injector also includes an injection control valve assembly including a control valve movable from a closed position, where the control valve blocks the check control chamber from the low pressure drain, to an open position. The fuel injector also includes a split check assembly within the injector housing, and including a control piece having a check top surface exposed to the check control chamber, an outlet piece coaxially arranged with the control piece, and a check sleeve receiving therein at least one of the control piece or the outlet piece. The outlet piece includes a tip in contact with the injector housing to block the spray outlets from the fuel cavity, and the control piece and the outlet piece are movable from advanced positions to retracted positions to open the spray outlets to the fuel cavity, based on the moving of the control valve from the closed position to the open position. A trapped volume is formed between the control piece and the outlet piece, within the check sleeve, and hydraulically couples the control piece to the outlet piece. A starting rate shape clearance fluidly connects the trapped volume to the fuel cavity and is formed between the check sleeve and the at least one of the control piece or the outlet piece received therein.

In another aspect, a fuel injector includes an injector housing defining a longitudinal axis, and having formed therein a high pressure inlet, a fuel cavity fluidly connected to the high pressure inlet, a low pressure drain, and a check control chamber. The injector housing further includes a nozzle having formed therein a plurality of spray outlets. The fuel injector further includes an injection control valve assembly having a control valve movable from a closed position, where the control valve blocks the check control chamber from the low pressure drain, to an open position. The fuel injector also includes a split check assembly within the injector housing, and having a control piece with a check top surface exposed to the check control chamber, an outlet piece coaxially arranged with the control piece and having a tip in contact with the injector housing to block the spray outlets from the fuel cavity. The split check assembly further includes a check sleeve receiving the control piece and the outlet piece therein and, together with the control piece and the outlet piece, forming a trapped volume. The trapped volume hydraulically couples movement of the control piece and the outlet piece from advanced positions to retracted positions, to open the spray outlets to the fuel cavity, based on the moving of the control valve from the closed position to the open position. A starting rate shape clearance is formed between the check sleeve and at least one of the control piece or the outlet piece and fluidly connects the trapped volume to the fuel cavity.

In still another aspect, a method of operating a fuel system includes moving a control piece in a split check assembly in a fuel injector from an advanced position toward a retracted position, and opening an outlet piece of the split check assembly hydraulically coupled to the control piece, based on the moving of the control piece toward a retracted position. The method further includes leaking fuel, through a starting rate shape clearance formed between a check sleeve and at least one of the control piece or the outlet piece, between a fuel cavity in the fuel injector and a trapped volume formed between the control piece and the outlet piece, during the opening of the outlet piece. The method still further includes shaping a rate of fuel injection through spray outlets in the fuel injector opened by the outlet piece, based on the leaking of fuel between the fuel cavity and the trapped volume.

DETAILED DESCRIPTION

Figure 1:
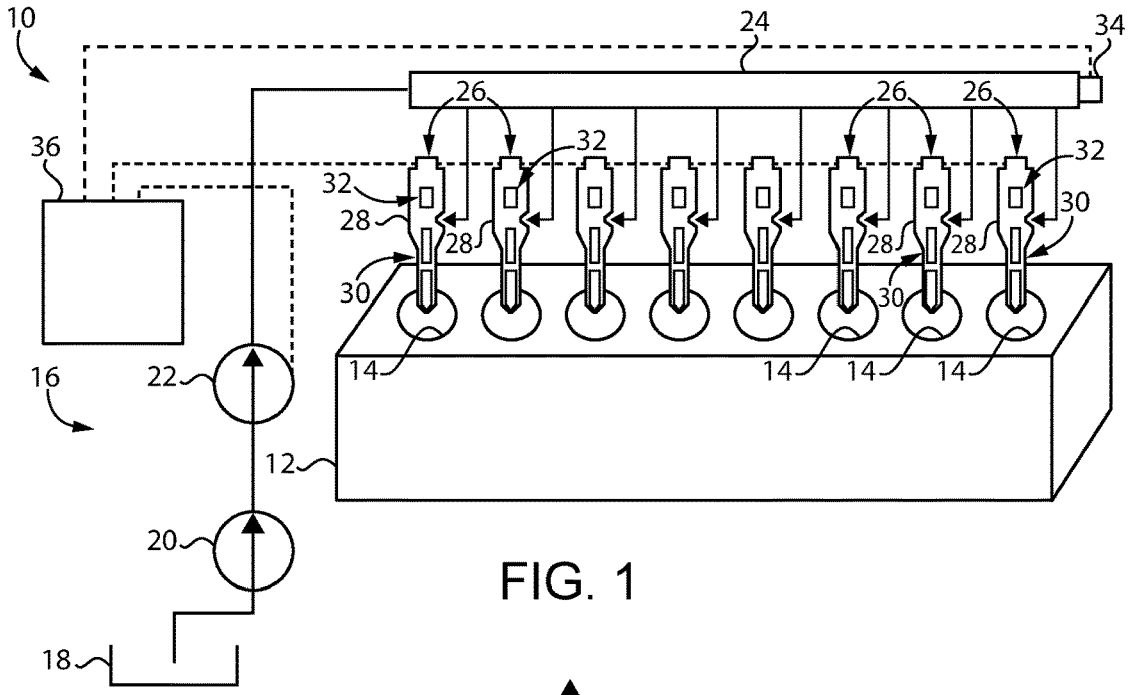
FIG. 1 is a diagrammatic view of an internal combustion engine system, according to one embodiment.

Referring to FIG. 1, there is shown an internal combustion engine system 10 according to one embodiment. Engine system 10 includes a cylinder block 12 having a plurality of cylinders 14 formed therein. Cylinders 14 can include any number of cylinders in any suitable arrangement, such as an in-line pattern as shown, a V-pattern, or still another. Engine system 10 can include a directly injected compression-ignition engine structured to operate on a liquid fuel such as a liquid diesel distillate fuel, however, the present disclosure is not thereby limited. Engine system 10 may be a single-fuel engine, however, the present disclosure is also not limited in this regard and engine system 10 could be a dual gaseous and liquid fuel engine in some embodiments. Engine system 10 further includes a fuel system 16 having a liquid fuel supply or tank 18, a low pressure transfer pump 20, and a high pressure pump 22 structured to pressurize a fuel and supply the same to a pressurized fuel reservoir or common rail 24. Common rail 24 may include a single monolithic fuel reservoir but could include a plurality of separate fuel reservoirs in the nature of accumulators and/or a plurality of separate pressurized lines or the like coupled together in a so-called daisy chain arrangement. A pressure sensor 34 may be coupled to common rail 24 in a generally conventional manner and is in communication with an electronic control unit 36. Electronic control unit 36 may receive pressure signals from pressure sensor 34 and responsively operate high pressure pump 22 to maintain a fuel pressure in common rail 24 at a desired level, or adjust the fuel pressure to a desired level for various purposes. Common rail 24 is fluidly connected to a plurality of fuel injectors 26 each positioned so as to extend into and fluidly communicate with a respective one of cylinders 14. Fuel injectors 26 may be substantially identical to one another. Each of fuel injectors 26 includes an injector housing 28 and having within the respective injector housing 28, or coupled with the respective injector housing 28, an injection control valve assembly 32. Each injection control valve assembly 32 may be electrically actuated by way of control currents produced by electronic control unit 36 in a generally conventional manner. Each fuel injector 26 may further include a split check assembly 30 within the respective injector housing 28, details and functionality of which are further discussed herein. As will be further apparent from the following description each split check assembly 30 may be structured to improve minimum delivery and fuel injection rate shape, including a starting fuel injection rate shape.

Figure 2:
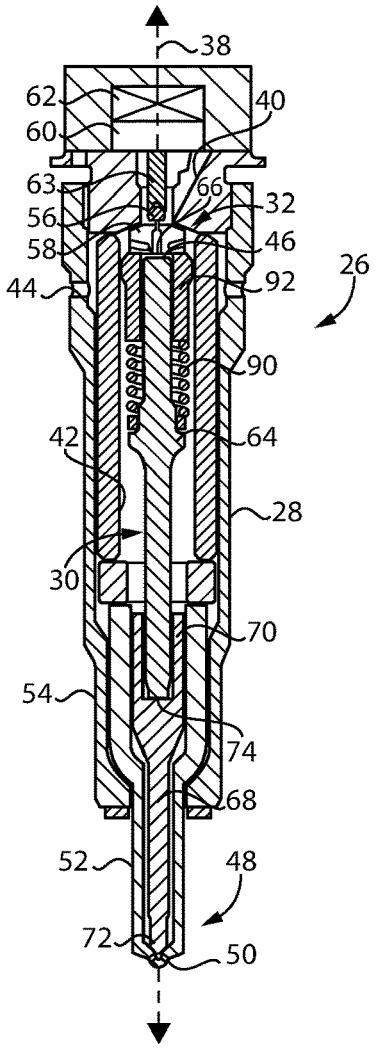
FIG. 2 is a sectioned side diagrammatic view of a fuel injector, according to one embodiment.
Figure 3:
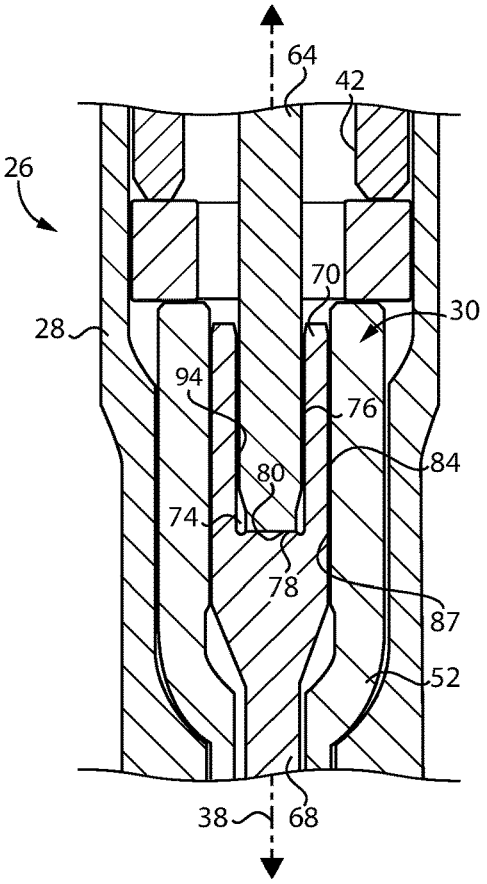
FIG. 3 is a sectioned side diagrammatic view of a portion of the fuel injector of FIG. 2.
Figure 4:
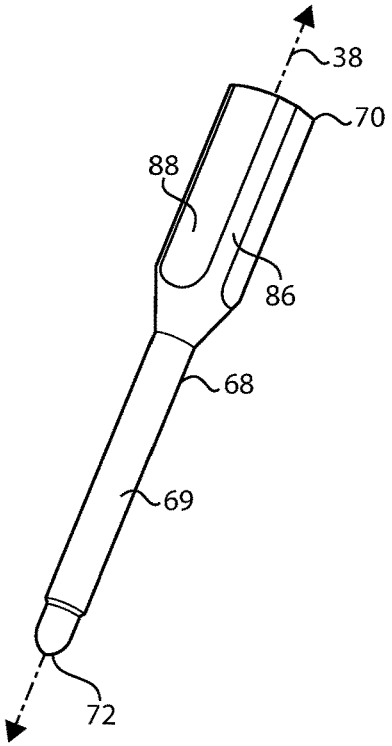
FIG. 4 is a diagrammatic view of an outlet piece for a split check assembly, according to one embodiment.

Referring also now to FIGS. 2-4, each fuel injector 26, hereinafter referred to in the singular, includes an injector housing 28 as noted above. Injector housing 28 may include a plurality of housing or pressure containment components and a plurality of internal components movable with respect to the housing and pressure containment components. Injector housing 28 defines a longitudinal axis 38 and has formed therein a high pressure inlet 40 fluidly connected to common rail 24, a fuel cavity 42 fluidly connected to high pressure inlet 40, a low pressure drain 44, and a check control chamber 46. Injector housing 28 further includes a nozzle 48 having formed therein a plurality of spray outlets 50. In the illustrated embodiment nozzle 48 includes a tip piece 52 defining spray outlets 50, positioned within a casing 54. Various other injector housing components (not numbered) are clamped together within injector housing 28. Low pressure drain 44 can be, or be fluidly connected to, a low pressure return line (not shown) that drains fuel used for actuating fuel injector 26 back to fuel tank 18, or to a fuel supply line typically connected fluidly between transfer pump 20 and high pressure pump 22. High pressure inlet 40 may fluidly connect to common rail 24 in any suitable manner, for instance, by way of a so-called quill connector clamped into sealing contact with injector housing 28.

Fuel injector 26 further includes injection control valve assembly 32, having a control valve 56 movable from a closed position, where control valve 56 blocks check control chamber 46 from low pressure drain 44, to an open position where control valve 56 does not block check control chamber 46 from low pressure drain 44. Control valve assembly 32 may also include an electrical actuator 62, an armature 60 movable relative to electrical actuator 62, and a rod or the like coupled between armature 60 and control valve 56. Control valve 56 can include a spherical control valve, a hemispheric control valve, a flat valve, a three-way poppet valve, or any other suitable valve type that can establish and disestablish the various fluid connections in a suitable manner. Control valve assembly 32 may also include a valve seat orifice plate 58 contacted by control valve 56 at the closed position, and not contacted by control valve 56 at the open position. Valve seat orifice plate 58 may include a plurality of orifices (not numbered) formed therein for pressurizing and depressurizing check control chamber 46 in a suitable manner.

A split check assembly 30 is within injector housing 28 as noted above. Split check assembly 30 includes a control piece 64 movable, for example, within a guide piece 92 in opposition to a closing bias of a biasing spring 90. Control piece 64 further includes a check top surface 66 exposed to check control chamber 46. Split check assembly 30 also includes an outlet piece 68 coaxially arranged with control piece 64, and a check sleeve 70 receiving therein at least one of control piece 64 or outlet piece 68. Outlet piece 68 includes a tip 72 in contact with injector housing 28 to block spray outlets 50 from fuel cavity 42, and control piece 64 and outlet piece 68 are movable from advanced positions to retracted positions to open spray outlets 50 to fuel cavity 42, based on the moving of control valve 56 from the closed position to the open position. When control piece 68 is lifted from contact with injector housing 28 blocking spray outlets 50, spray outlets 50 are fluidly connected to fuel cavity 42, where pressurized fuel resides. Tip 72 may be part of a needle 69 of outlet piece 68.

Also in the illustrated embodiment, outlet piece 68 is guided within a guide bore 87 formed in tip piece 52. Control piece 64 may be guided within a bore 94 formed in outlet piece 68, and as noted above within a guide piece 92. Control piece 64 may be principally guided by way of interaction with outlet piece 68. Biasing spring 90 may be held in compression between guide piece 92 and control piece 64. Outlet piece 68 may further include a plurality of guide surfaces 86 structured to contact tip piece 52 and having a guide clearance therewith. A plurality of flow surfaces 88 may be in an alternating arrangement with guide surfaces 86 around longitudinal axis 38. A guide clearance 84 may thus be understood to be formed between check sleeve 70 and injector housing 28, and between check sleeve 70 and tip piece 52 as illustrated. A fuel supply clearance, larger than guide clearance 84, may be formed between check sleeve 70 and injector housing 28, as illustrated between flow surfaces 88 and tip piece 52, and extends between fuel cavity 42 and spray outlets 50. In other embodiments a different plumbing strategy for supplying pressurized fuel to spray outlets 50 other than between a movable piece of split check assembly 30 and injector housing 28 might be used.

A trapped volume 74 is formed between control piece 64 and outlet piece 68, within check sleeve 70, and hydraulically couples control piece 64 to outlet piece 68 as further discussed herein. A starting rate shape clearance 76 fluidly connects trapped volume 74 to fuel cavity 42 and is formed between check sleeve 70 and the at least one of control piece 64 and outlet piece 68 received therein. Control piece 64 may further include a check end surface 78 opposite to check top surface 66. Outlet piece 68 includes a second check top surface 80 opposite to tip 72, and trapped volume 74 may be formed between check end surface 78 and second check top surface 80. Check end surface 78 may have a larger surface area exposed to a fluid pressure of trapped volume 74, and second check top surface 80 may have a smaller surface area exposed to the fluid pressure of trapped volume 74.

Also in the illustrated embodiment, starting rate shape clearance 76 is formed peripherally between check sleeve 70 and the one of control piece 64 and outlet piece 68 received therein. Starting rate shape clearance 76 may extend circumferentially around longitudinal axis 38, and trapped volume 74 may be fluidly connected to fuel cavity 42 only by starting rate shape clearance 76. It will further be noted from FIGS. 2-4 that check sleeve 70 is movable within injector housing 28, and is formed integrally with outlet piece 68, such that check sleeve 70 and outlet piece 68 move together between an advanced position and a retracted position. In other embodiments, further discussed herein, a check sleeve is formed integrally with a control piece, and moves together with the control piece between an advanced position and a retracted position. It will also be further understood by way of the following description that a difference in motion of an outlet piece and a control piece between advanced positions and retracted positions, as modulated by leakage of fuel through starting rate shape clearance 76, assists in obtaining a desired starting rate shape of fuel injection and improved minimum delivery capability.

Figure 5:
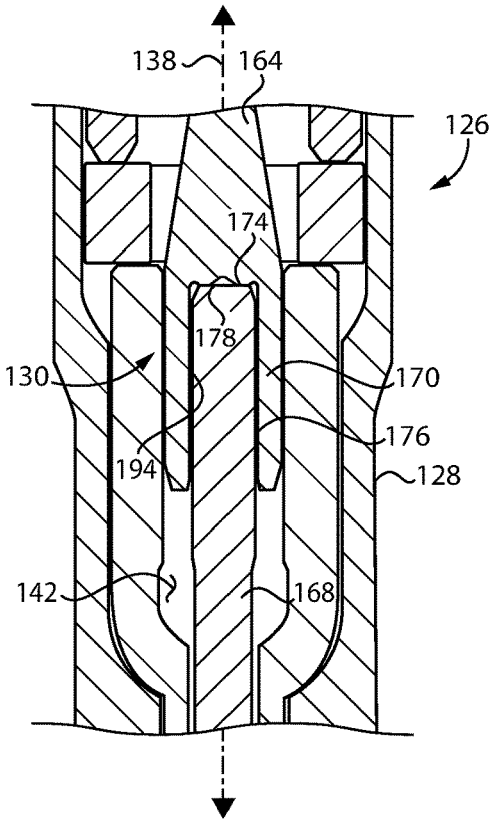
FIG. 5 is a sectioned side diagrammatic view of a portion of a fuel injector, according to one embodiment.

Referring now to FIG. 5, there is shown a fuel injector 126 according to another embodiment. Fuel injector 126 has certain similarities with fuel injector 26 discussed above, but certain differences. Fuel injector 126 includes an injector housing 128 defining a longitudinal axis 138. A split check assembly 130 is within injector housing 128 and functions generally analogously to split check assembly 30 discussed above. A control piece 164 and an outlet piece 168 and a check sleeve 170 define a trapped volume 174. Outlet check 168 is positioned partially within check sleeve 170, and a starting rate shape clearance 176 fluidly connects trapped volume 174 to a fuel cavity 142. In contrast to split check assembly 30, rather than a check sleeve formed integrally with an outlet piece, in split check assembly 130 check sleeve 170 is formed integrally with control piece 164. Thus, check sleeve 170 forms a bore 194 that receives outlet piece 168 and starting rate shape clearance 176 fluidly connects trapped volume 174 to fuel cavity 142 below the coupling of the respective control piece and outlet piece.

Figure 6:
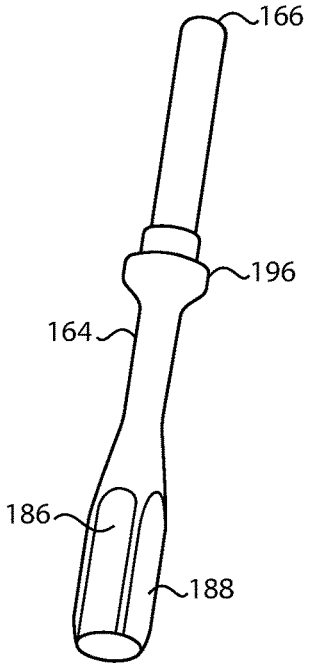
FIG. 6 is a diagrammatic view of a control piece for a split check assembly, according to one embodiment.

Referring also to FIG. 6, control piece 164 may have a guide clearance with injector housing 128, and includes guide surfaces 186 structured to contact injector housing 128. Control piece 164 may have a fuel supply clearance, larger than the guide clearance, formed between fuel supply surfaces 188 and injector housing 128. Guide surfaces 186 may be in an alternating arrangement with fuel supply surfaces 188 circumferentially around longitudinal axis 138. A check top surface 166 is formed on control piece 164 and is to be exposed to a check control chamber within fuel injector 126. A spring flange or stop 196 is also formed on control piece 164 and structured to contact a biasing spring within fuel injector 126, generally analogous to the foregoing embodiment.

Figure 7:
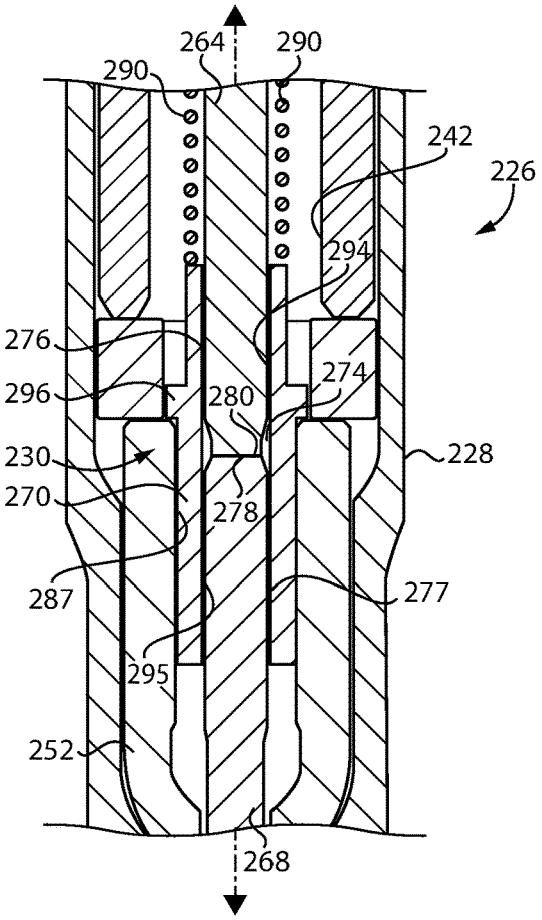
FIG. 7 is a sectioned side diagrammatic view of a portion of a fuel injector, according to one embodiment.
Figure 8:
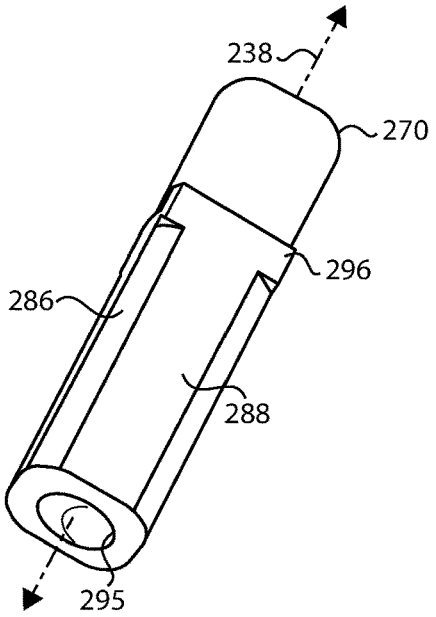
FIG. 8 is a diagrammatic view of a check sleeve for a split check assembly, according to one embodiment.

Referring now to FIGS. 7-8, there is shown a portion of a fuel injector 226 and components thereof according to another embodiment. Although not pictured, it will be understood fuel injector 226 may include a control valve assembly and other features similar to those used with other embodiments described herein. Analogously, still further embodiments discussed below will typically include many of the same or similar parts and/or functionality even where not specifically illustrated. Fuel injector 226 includes an injector housing 228 defining a longitudinal axis 238. A trapped volume 274 is formed between a control piece 264 and an outlet piece 268 in a split check assembly 230, and hydraulically couples control piece 264 to outlet piece 268. Split check assembly 230 also includes a check sleeve 270. Check sleeve 270 is in contact with injector housing 228, in the illustrated embodiment in contact with a tip piece 252. Check sleeve 270 has an axially extending bore formed by a first bore section 294 receiving control piece 264, and a second bore section 295 receiving outlet piece 268. A check end surface 278 of control piece 264 is exposed to a fluid pressure of trapped volume 274. A check top surface 280 of outlet piece 268 is also exposed to a fluid pressure of trapped volume 274. Check end surface 278 may have a larger surface area and check top surface 280 may have a smaller surface area, exposed to the fluid pressure of trapped volume 274. A starting rate shape clearance 276 is formed between first bore section 294 and control piece 264. A second starting rate shape clearance 277 is formed between second bore section 295 and outlet piece 268. Another bore 287 is formed in tip piece 252. Check sleeve 270 may have a guide clearance with injector housing 228, with tip piece 252, for example, structured to be contacted by guide surfaces 286 of check sleeve 270. Guide surfaces 286 may be in an alternating arrangement, circumferentially around longitudinal axis 238, with fuel supply surfaces 288, forming a fuel supply clearance with injector housing 228 larger than the respective guide clearance. A flange or other protrusion 296 of check sleeve 270 extends radially outward and contacts tip piece 252 to set a position of check sleeve 270 within injector housing 228. A biasing spring 290 is in contact with check sleeve 270, and may be held in compression in injector housing 228 to hold check sleeve 270 in place as desired.

Figure 10:
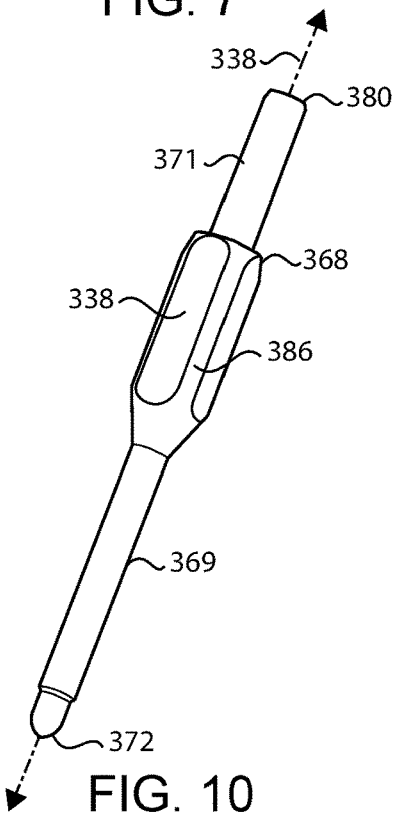
FIG. 10 is a diagrammatic view of an outlet piece for a split check assembly, according to one embodiment.
Figure 9:
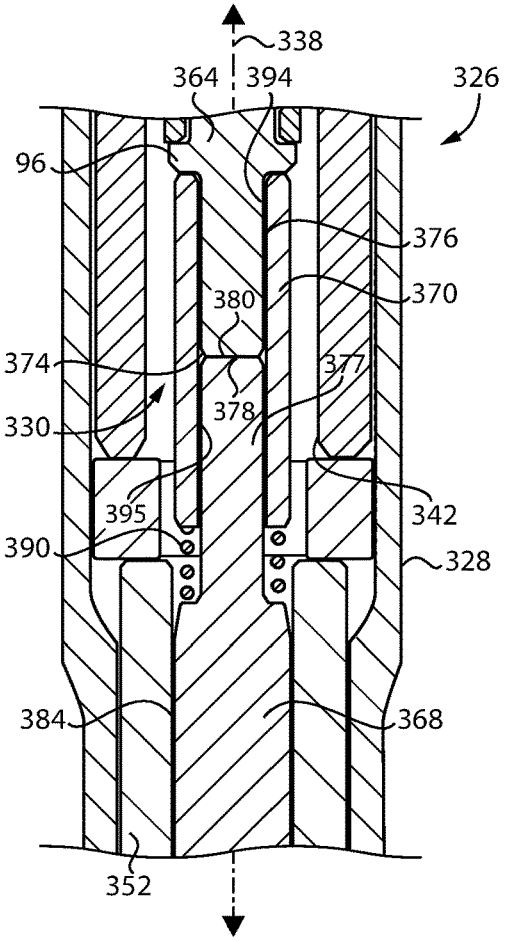
FIG. 9 is a sectioned side diagrammatic view of a portion of a fuel injector, according to one embodiment.

Referring now to FIGS. 9 and 10, there is shown a fuel injector 326 according to yet another embodiment, and including an injector housing 328 defining a longitudinal axis 338. A split check assembly 330 is within injector housing 328 and includes a control piece 364, an outlet piece 368, and a check sleeve 370. A trapped volume 374 is formed between control piece 364 and outlet piece 368, within check sleeve 370, and hydraulically couples control piece 364 to outlet piece 368. Check sleeve 370 includes an axially extending bore formed by a first bore section 394, and a second bore section 395, receiving control piece 364 and outlet piece 368, respectively. A first starting rate shape clearance 376 fluidly connects trapped volume 374 to a fuel cavity 342. First starting rate shape clearance 376 is formed between check sleeve 270 and control piece 364. A second starting rate shape clearance 377 fluidly connects trapped volume 374 to fuel cavity 342 and is formed between check sleeve 370 and outlet piece 368. Outlet piece 368 may have a guide clearance 384 with injector housing 328, and as illustrated with a tip piece 352 of injector housing 328. A biasing spring 390 is held in compression between check sleeve 370 and outlet piece 368. Check sleeve 370 is held, based on a biasing force of biasing spring 390, in contact with a projecting flange or other protrusion 396 of control piece 364. Control piece 364 includes a check end surface 378, which may have a larger surface area, exposed to a fluid pressure of trapped volume 374. Outlet piece 368 includes a check top surface 380, which may have a smaller surface area, exposed to a fluid pressure of trapped volume 374. As shown in FIG. 10, outlet piece 368 includes a needle 369 having a tip 372 structured to contact injector housing 328 for opening and closing spray outlets. A check end shaft 371 extends to a check top surface 380. Outlet piece 368 also includes guide surfaces 386 in an alternating arrangement with fuel supply surfaces 388, circumferentially around longitudinal axis 338, and respectively structured and functioning analogous to similar structures in other embodiments described herein.

Figure 11:
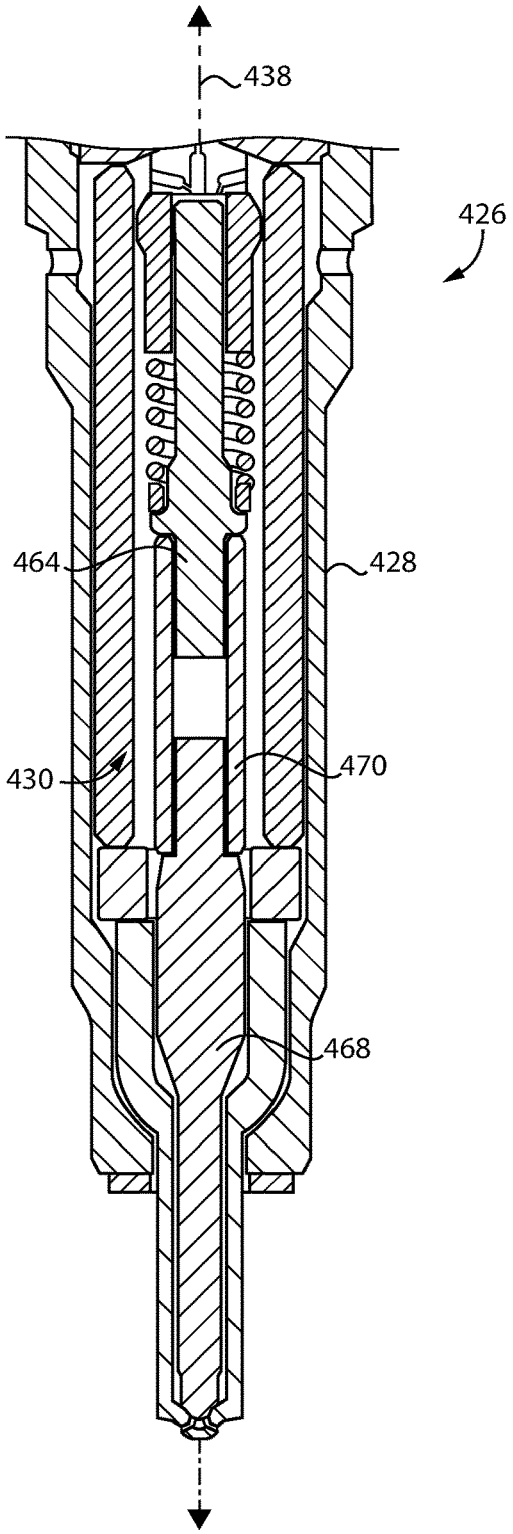
FIG. 11 is a sectioned side diagrammatic view of a fuel injector, according to one embodiment.
Figure 12:
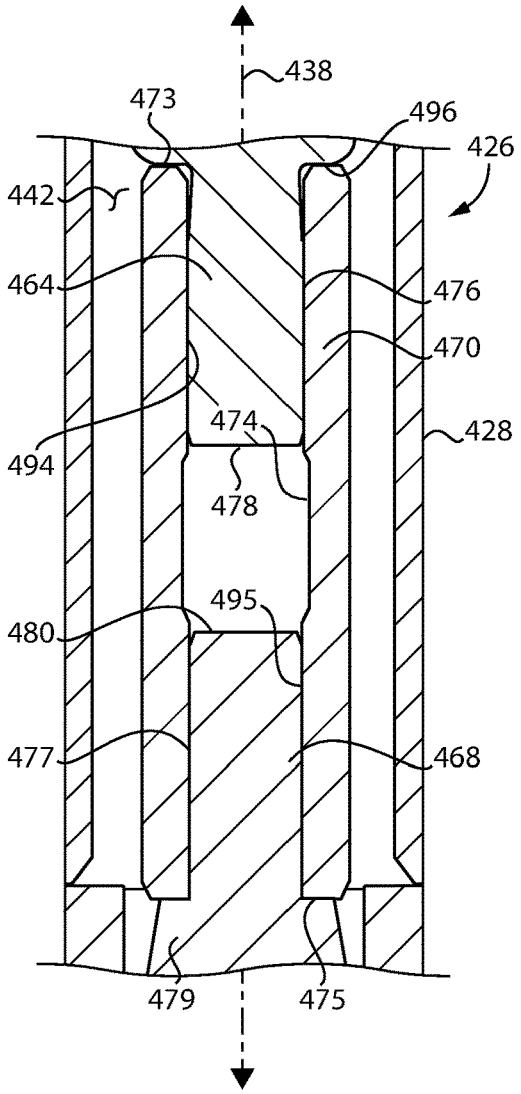
FIG. 12 is a sectioned side diagrammatic view of a portion of the fuel injector of FIG. 11.

Referring now to FIGS. 11 and 12, there is shown a fuel injector 426 according to yet another embodiment, and including an injector housing 428 having a split check assembly 430 positioned therein. Split check assembly 430 includes a control piece 464, an outlet piece 468, and a check sleeve 470. Injector housing 428 defines a longitudinal axis 438. A trapped volume 474 is formed between control piece 464 and outlet piece 468, and hydraulically couples control piece 464 to outlet piece 468. Check sleeve 470 has an axially extending bore formed by a first bore section 494 receiving control piece 464, and a second bore section 495 receiving outlet piece 468. Check sleeve 470 includes a first axial end surface 473 (a first stop surface) in contact with a shoulder 496 of control piece 464. Check sleeve 470 also includes a second axial end surface 475 (a second stop surface) in contact with a shoulder 479 of outlet piece 468. A first starting rate shape clearance 476 is formed between check sleeve 470 and control piece 464 and fluidly connects trapped volume 474 to a fuel cavity 442. A second starting rate shape clearance 477 is formed between outlet piece 468 and check sleeve 470, and fluidly connects trapped volume 474 to fuel cavity 442. Check sleeve 470 is held captive between control piece 464 and outlet piece 468, in contact with each of stop surface 496 and stop surface 479, at least at advanced positions of control piece 464 and outlet piece 468, and potentially also at their respective retracted positions. Trapped volume 474 extends axially between check end surface 478 and check top surface 480, when control piece 464 and outlet piece 468 are at the respective advanced positions and retracted positions.

Figure 13:
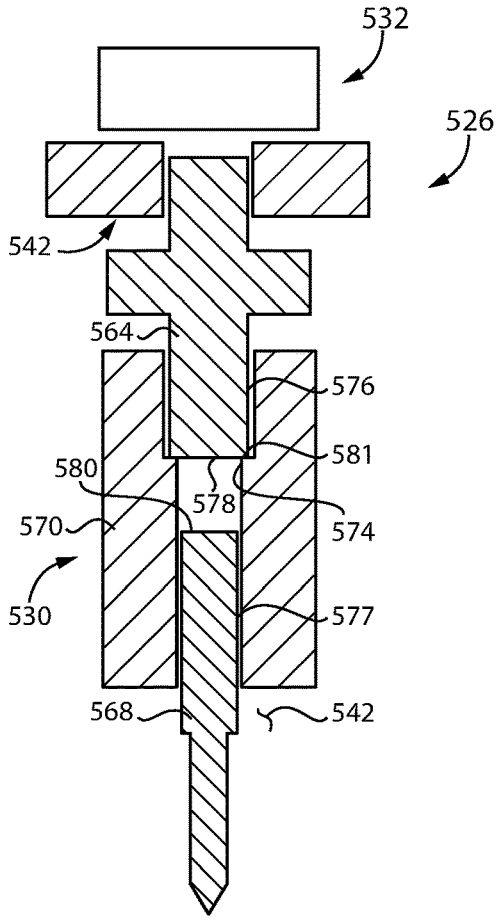
FIG. 13 is a diagrammatic view of a fuel injector, according to one embodiment.

Referring to FIG. 13, there is shown a fuel injector 526 according to yet another embodiment and including an injector housing 528 and a split check assembly 530 including a control piece 564, an outlet piece 568, and a check sleeve 570. Control piece 564 includes a check end surface 578, and outlet piece 568 includes a check top surface 580. An injection control valve assembly is shown at 532. A trapped volume 574 is formed, within check sleeve 570, between control piece 564 and outlet piece 568. A first starting rate shape clearance 576 extends between control piece 564 and check sleeve 570, and a second starting rate shape clearance 577 extends between outlet piece 568 and check sleeve 570. Starting rate shape clearances 576 and 577 fluidly connect trapped volume 574 to a fuel cavity 542. Control piece 564 contacts a stop 581 formed by check sleeve 570 when at an advanced position.

INDUSTRIAL APPLICABILITY

Figure 14:
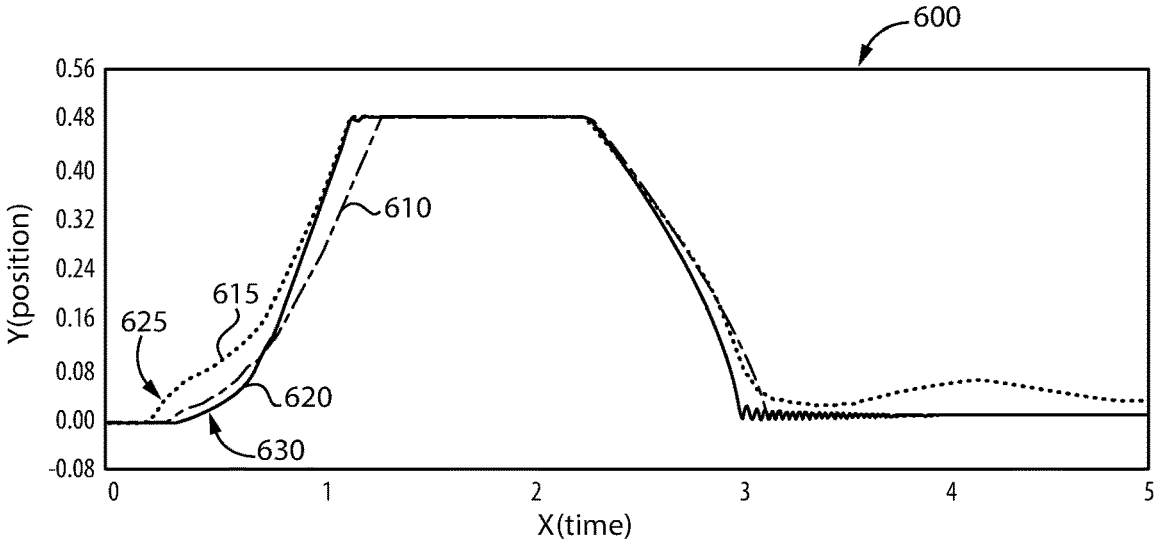
FIG. 14 is a graph of position, with respect to time, of components of a split check assembly according to the present disclosure, in comparison with position of a check in a known design.

Referring to the drawings generally, but now also to FIG. 14, there is shown a graph 600 illustrating check position 610 on the X-axis for a known, single piece check, over time on the Y-axis. A position of a control piece in a split check assembly according to the present disclosure is shown at line 615, and a position of an outlet piece in a split check assembly according to the present disclosure is shown at line 620. During operating a split check assembly according to the present disclosure, when a control valve assembly is energized to fluidly connect a check control chamber to low pressure, a check top surface in a control piece will be exposed to a reduced pressure in the check control chamber and begin to move relatively quickly, approximately as shown via reference numeral 625, from an advanced position toward a retracted position. Motion of the control piece will tend to create a drop in the pressure of a trapped volume extending between the control piece and an outlet piece as described herein. The control piece will then tend to begin to slow down due to this drop in pressure, as can be seen generally by way of the portion of line 615 identified with reference numeral 625. As a sufficient pressure drop in the trapped volume occurs, the outlet piece will start to move, beginning to open, based on the moving of the control piece. An incipient opening speed of the outlet piece can be seen generally along line 620 as indicated by reference numeral 630. The motion of the outlet piece can then begin to give the control piece a boost and cause an increasing of its speed from the incipient speed. The increased speed of the control piece can then, in turn, enable the outlet piece to speed up.

The leaking of fuel through one or more starting rate shape clearances between the trapped volume and the fuel cavity can assist in obtaining this desired independent, but hydraulically coupled motion of the respective pieces of the split check assembly as the pieces move from advanced positions toward retracted positions. As a result an initially slow, starting rate of fuel injection can be observed as the outlet piece relatively gradually opens with its incipient opening speed limited by the leaking of fuel, but then begins to accelerate at least briefly to increase the injection rate. This contrasts with certain known designs, including the known single check design illustrated, where it can be seen that an incipient speed of check motion is relatively slow but also remains relatively slow. It will further be recalled that the surface area of a control piece exposed to a trapped volume as discussed herein can be relatively larger than the surface area of an outlet piece exposed to the trapped volume. As a result the motion of the control piece can require displacement of a relatively larger volume of fluid resulting in some hydraulic assistance that pulls the outlet piece along. When pressure is restored to the check control chamber by blocking the check control chamber from low pressure, shortly after time 2 in the FIG. 14 illustration, the control piece will be urged downwardly to increase a pressure in the trapped volume, and urge the outlet piece closed to end fuel injection.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel injector comprising:

an injector housing defining a longitudinal axis, and having formed therein a high pressure inlet, a fuel cavity fluidly connected to the high pressure inlet, a low pressure drain, and a check control chamber, and the injector housing further including a nozzle having formed therein a plurality of spray outlets;

an injection control valve assembly including a control valve movable from a closed position, where the control valve blocks the check control chamber from the low pressure drain, to an open position;

a split check assembly within the injector housing and including a control piece having a check top surface exposed to the check control chamber, an outlet piece coaxially arranged with the control piece, and a check sleeve receiving therein at least one of the control piece or the outlet piece;

the outlet piece having a tip in contact with the injector housing to block the spray outlets from the fuel cavity, and the control piece and the outlet piece are movable from advanced positions to retracted positions to open the spray outlets to the fuel cavity, based on the moving of the control valve from the closed position to the open position; and a trapped volume is formed between the control piece and the outlet piece, within the check sleeve, and hydraulically couples the control piece to the outlet piece, and a starting rate shape clearance fluidly connects the trapped volume to the fuel cavity and is formed between the check sleeve and the at least one of the control piece or the outlet piece received therein;

wherein the check sleeve is movable within the injector housing, together with one of the control piece or the outlet piece, between an advanced position and a retracted position; and wherein a guide clearance is formed between the check sleeve and the injector housing, and a fuel supply clearance is formed between the check sleeve and the injector housing and extends between the fuel cavity and the plurality of spray outlets.

2. The fuel injector of claim 1 wherein:

the control piece includes a check end surface opposite to the check top surface; and the outlet piece includes a second check top surface opposite to the tip, and the trapped volume is formed between the check end surface and the second check top surface.

3. The fuel injector of claim 2 wherein:

the check end surface has a larger surface area exposed to a fluid pressure of the trapped volume; and the second check top surface has a smaller surface area exposed to the fluid pressure of the trapped volume.

4. The fuel injector of claim 2 wherein the starting rate shape clearance is formed peripherally between the check sleeve and the one of the control piece or the outlet piece received therein, and extends circumferentially around the longitudinal axis.

5. The fuel injector of claim 4 wherein the trapped volume is fluidly connected to the fuel cavity only by the starting rate shape clearance.

6. The fuel injector of claim 1 wherein one of the control piece or the outlet piece is formed integrally with the check sleeve.

7. The fuel injector of claim 6 wherein the outlet piece is formed integrally with the check sleeve.

8. A fuel injector comprising:

an injector housing defining a longitudinal axis, and having formed therein a high pressure inlet, a fuel cavity fluidly connected to the high pressure inlet, a low pressure drain, and a check control chamber, and the injector housing further including a nozzle having formed therein a plurality of spray outlets;

an injection control valve assembly including a control valve movable from a closed position, where the control valve blocks the check control chamber from the low pressure drain, to an open position;

a split check assembly within the injector housing and including a control piece having a check top surface exposed to the check control chamber, and an outlet piece coaxially arranged with the control piece and having a tip in contact with the injector housing to block the spray outlets from the fuel cavity;

the split check assembly further including a check sleeve receiving the control piece and the outlet piece therein and, together with the control piece and the outlet piece, forming a trapped volume;

the trapped volume hydraulically couples movement of the control piece and the outlet piece from advanced positions to retracted positions, to open the spray outlets to the fuel cavity, based on the moving of the control valve from the closed position to the open position;

a starting rate shape clearance is formed between the check sleeve and at least one of the control piece or the outlet piece and fluidly connects the trapped volume to the fuel cavity; and the control piece further including a check end surface opposite to the check top surface and exposed to a fluid pressure of the trapped volume, and the outlet piece includes a second check top surface exposed to a fluid pressure of the trapped volume, and wherein the check end surface has a larger surface area and the second check top surface has a smaller surface area.

9. The fuel injector of claim 8 wherein the starting rate shape clearance is formed peripherally between the check sleeve and the control piece, and a second starting rate shape clearance is formed peripherally between the check sleeve and the outlet piece.

10. The fuel injector of claim 8 wherein:

the check sleeve is movable within the injector housing, together with one of the control piece or the outlet piece, between an advanced position and a retracted position;

a guide clearance is formed between the check sleeve and the injector housing; and a fuel supply clearance is formed between the check sleeve and the injector housing and extends between the fuel cavity and the plurality of spray outlets.

11. The fuel injector of claim 8 wherein the check sleeve is held captive between the control piece and the outlet piece.

12. The fuel injector of claim 11 wherein:

the control piece includes a first stop surface and the outlet piece includes a second stop surface; and the check sleeve is in contact with each of the first stop surface and the second stop surface when the control piece and the outlet piece are at the respective advanced positions.

13. A method of operating a fuel system comprising:

moving a control piece in a split check assembly in a fuel injector from an advanced position toward a retracted position;

opening an outlet piece of the split check assembly hydraulically coupled to the control piece based on the moving of the control piece toward a retracted position;

leaking fuel, through a starting rate shape clearance formed between a check sleeve and at least one of the control piece or the outlet piece, between a fuel cavity in the fuel injector and a trapped volume formed between the control piece and the outlet piece, during the opening of the outlet piece;

shaping a rate of fuel injection through spray outlets in the fuel injector opened by the opening of the outlet piece, based on the leaking of fuel between the trapped volume and the fuel cavity;

guiding moving the check sleeve, together with the one of the control piece or the outlet piece, between an advanced position and a retracted position via a guide clearance formed between the check sleeve and an injector housing of the fuel injector; and supplying the fuel for injection via a fuel supply clearance formed between the check sleeve and the injector housing and extending between the fuel cavity and the plurality of spray outlets.

14. The method of claim 13 further comprising limiting an incipient opening speed of the outlet piece based on the leaking of fuel.

15. The method of claim 14 further comprising increasing an opening speed of the outlet piece from the incipient opening speed.

16. The method of claim 15 wherein:

the moving of the control piece includes moving a control piece having a check end surface with a larger surface area exposed to a fluid pressure of the trapped volume; and the opening of the outlet piece includes opening an outlet piece having a check top surface having a smaller surface area exposed to the trapped volume.

* * * * *